US005290198A

United States Patent [19]

Nakayama

[11] Patent Number: 5,290,198

[45] Date of Patent: Mar. 1, 1994

[54] NURSING DOLL WITH SOUND MEANS

[75] Inventor: Toshiaki Nakayama, Tokyo, Japan

[73] Assignee: Yugen Kaisha Nakashou Giken, Tokyo, Japan

[21] Appl. No.: 569,413

[22] Filed: Aug. 17, 1990

[30] Foreign Application Priority Data

Aug. 19, 1989 [JP] Japan ..... 1-96868[U]

[51] Int. Cl.[5] ..... A63H 3/28

[52] U.S. Cl. ..... 446/297; 446/304; 446/301

[58] Field of Search ..... 446/297, 175, 300, 299, 446/304

[56] References Cited

U.S. PATENT DOCUMENTS

| | | | |
|---|---|---|---|
| 3,583,093 | 6/1971 | Glass et al. | 446/299 |
| 3,641,703 | 2/1972 | Tepper | 446/300 |
| 4,249,338 | 2/1981 | Wexler | 446/297 |
| 4,276,714 | 7/1981 | Albert et al. | 446/300 |
| 4,799,171 | 1/1989 | Cummings | 446/175 |

FOREIGN PATENT DOCUMENTS

| | | | |
|---|---|---|---|
| 2501384 | 7/1975 | Fed. Rep. of Germany | 446/46 |

*Primary Examiner*—Robert A. Hafer
*Assistant Examiner*—David J. Kenealy
*Attorney, Agent, or Firm*—Gifford, Groh, Sprinkle, Patmore and Anderson

[57] ABSTRACT

A doll having a sensor for determining the insertion of a top portion of a nursing bottle. The sensor includes a movable portion pivoting in response to insertion of the top portion of the nursing bottle. A contact point secures to one end of the movable portion and engages a contact member in order to cause a sound to be emitted by the doll. The sound is emitted from a speaker placed within the doll. A pair of pressure activated switches are also provided in the doll and operate in conjunction with the sensor to generate varied vocal responses.

5 Claims, 3 Drawing Sheets

| $A_3$ | $A_2$ | $A_1$ | $A_0$ | VOICE DATA |
|---|---|---|---|---|
| L | L | L | - | voice of drinking |
| L | L | H | H | voice of fun |
| L | H | H | - | voice of crying |
| H | L | H | - | voice of full |

NURSING DOLL WITH SOUND MEANS

BACKGROUND OF THE INVENTION

1. Field of the Invention

This invention relates to a doll.

2. Prior Art

Conventionally known in the art is a doll having a baby figure where one can give liquid like a milk to its mouth. A problem with the above art is that one loses his/her interest soon in the doll because one could not get reactions from the doll like a real baby, such as wetting its diaper when it is given milk.

The object of the present invention is to provide a doll which eliminates this problem.

SUMMARY OF THE PRESENT INVENTION

To solve the above-mentioned problem, a doll is provided with a sensor which, when an object is inserted into the doll's mouth from the outside, signals a speaker which emits predetermined words or sounds according to the signal issued from the sensor.

As an example, when a nursing bottle is inserted into the doll's mouth, a signal is outputted from the sensor and a sound emitted from the speaker which mimics sounds normally attendant to the function of drinking.

BRIEF DESCRIPTION OF THE DRAWINGS

A preferred embodiment of the present invention will be explained with reference to the drawings, wherein.

DETAILED DESCRIPTION OF A PREFERRED EMBODIMENT OF THE PRESENT INVENTION

Figure 1:
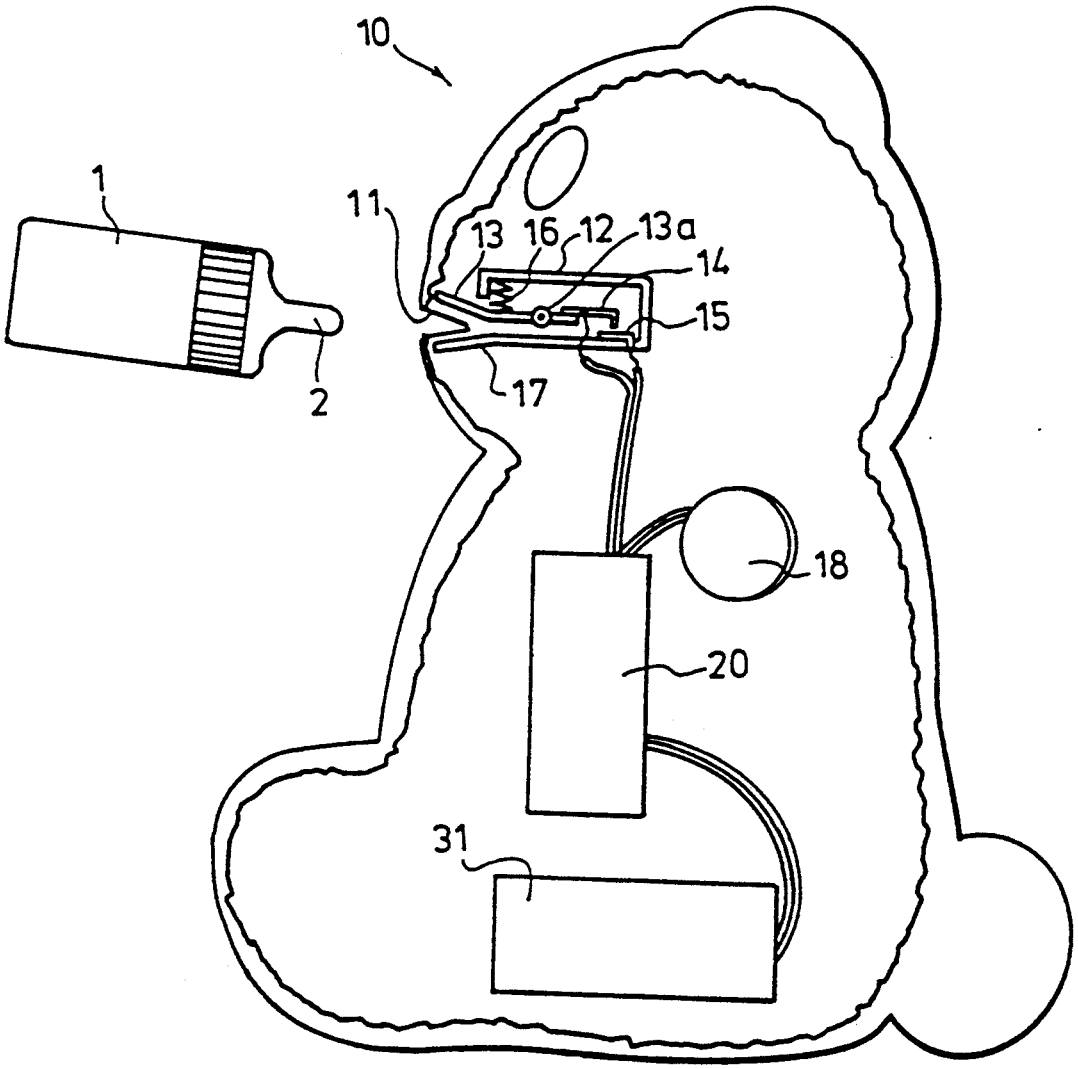
FIG. 1 is a cut-away view taken from the side of a teddy bear doll of a preferred embodiment of the present invention.

A mouth 11 of a doll 10 of the present invention is provided and may be opened to insert a top portion 2 of a toy nursing bottle 1. A sensor 12 is provided and senses when the nursing bottle 1 is inserted into the doll. The sensor 12 is positioned at the back of the mouth 11 of the doll 10.

The sensor 12 is constructed with a movable portion 13 which when the top portion 2 of the nursing bottle 1 is inserted, is bent along the opening of the mouth 11 and turns in a clockwise manner around a supporting point 13*a*. A contact point 14 is secured at the end of the movable portion 13 and includes one side which contacts the fixed other side of a contact portion 15. A spring 16 biases the movable portion 13 in a counterclockwise direction when not acted upon, as is shown in FIG. 1. A guide portion 17 guides the top portion 2 of the inserted nursing bottle 1 within the mouth as the top portion 7 acts upon the movable portion 13.

A switch 18 is placed inside of both sides of the doll 10 and is constructed to turn "ON" when one pushes both sides of the doll 10 from the outside.

The sensor 12 and the switches 18 are connected to a sound emitting apparatus 20 placed within an abdomen of the doll.

Figure 3:
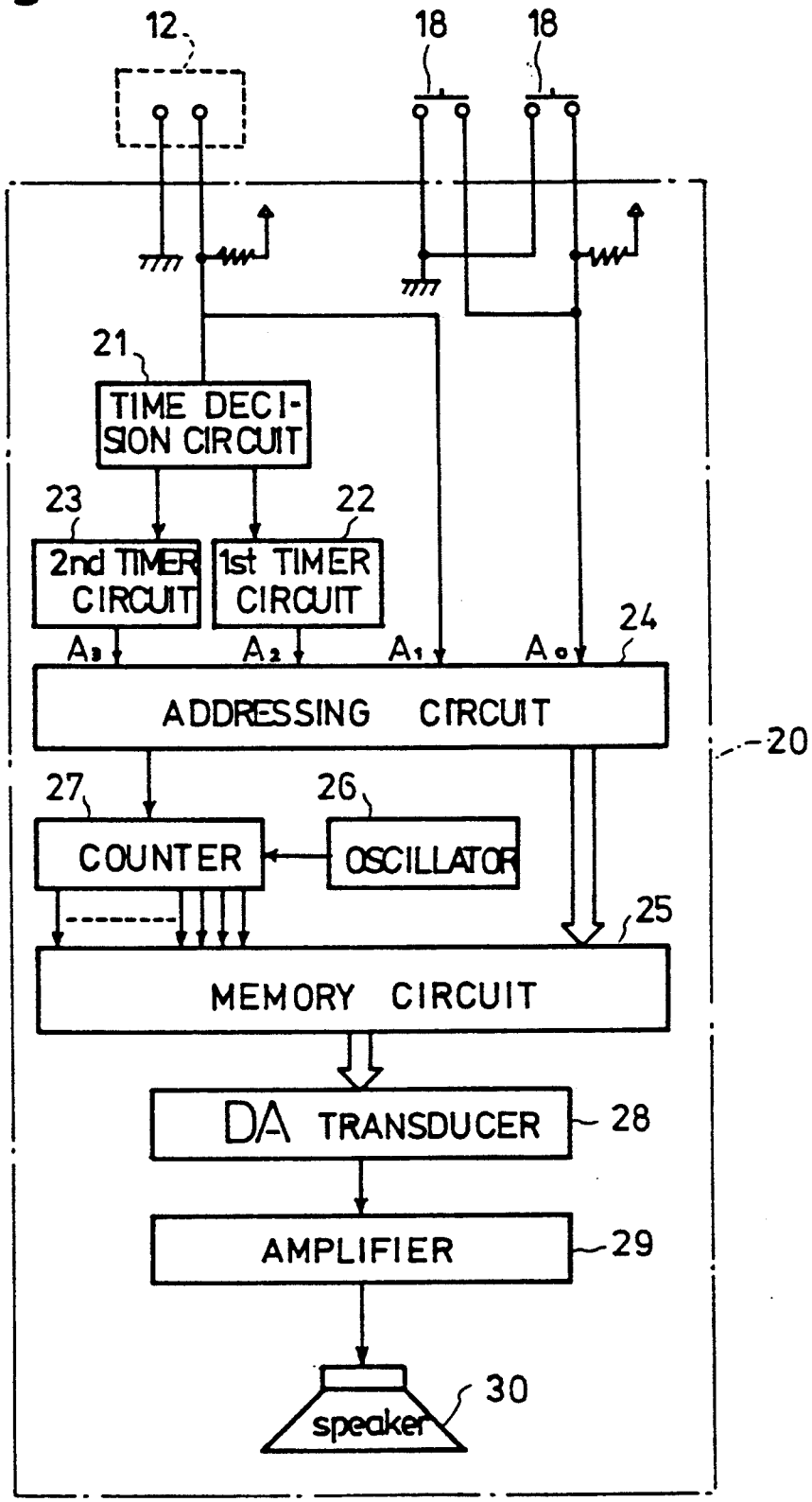
FIG. 3 is a schematic of the sensing and speaker apparatus of the present invention.

FIG. 3 is a view showing a structure of the sound emitting apparatus 20.

A time decision circuit 21 decides whether the "ON" signal of the switches 18 is in excess of a predetermined time or not, and outputs a decision signal to a first timer circuit 22 when the "ON" signal is shorter than the predetermined time. The time decision circuit 21 further outputs a decision signal to a second timer circuit 23 when the "ON" signal is longer than the predetermined time.

When the first and the second timer circuits 22, 23 receive the decision signal, each outputs an "H" level signal for a period as long as the predetermined time.

An addressing circuit 24 indicates the memory range of a memory circuit 25 on the basis of a signal level $A_0$ from the switches 18, a signal level $A_1$ from the sensor 12 and a signal level $A_2$ from the first and second times circuit.

At the memory circuit 25, the sound of drinking milk, a voice of joy, a crying voice, and a sound which expresses satisfaction are each memorized within four ranges as voice data. The addressing circuit 24 then indicates the voice data memorized in the memory circuit 25 by the level of the input signals $A_0$–$A_3$ as shown in FIG. 3.

An oscillator 26 of a predetermined frequency inputs a signal to a counter 27 to output to the memory circuit 25 in the order of the voice data of the range of the memory circuit 25 indicated by the addressing circuit 24. Further, the counter 27 is reset every time the range of the memory circuit 25 changes.

A DA transducer 28 transduces the voice data which is output from the memory circuit 25 to an analog signal. An amplifier 29 emits sound from the speaker 30 by amplifying the signal from the DA transducer 28. Further, the power source of the doll 10 is supplied by a battery (not shown) contained within a battery case 31 which is disposed in a in a lower extremity of the doll 10.

The movement of the doll will be explained hereinafter.

Figures 2, 4:
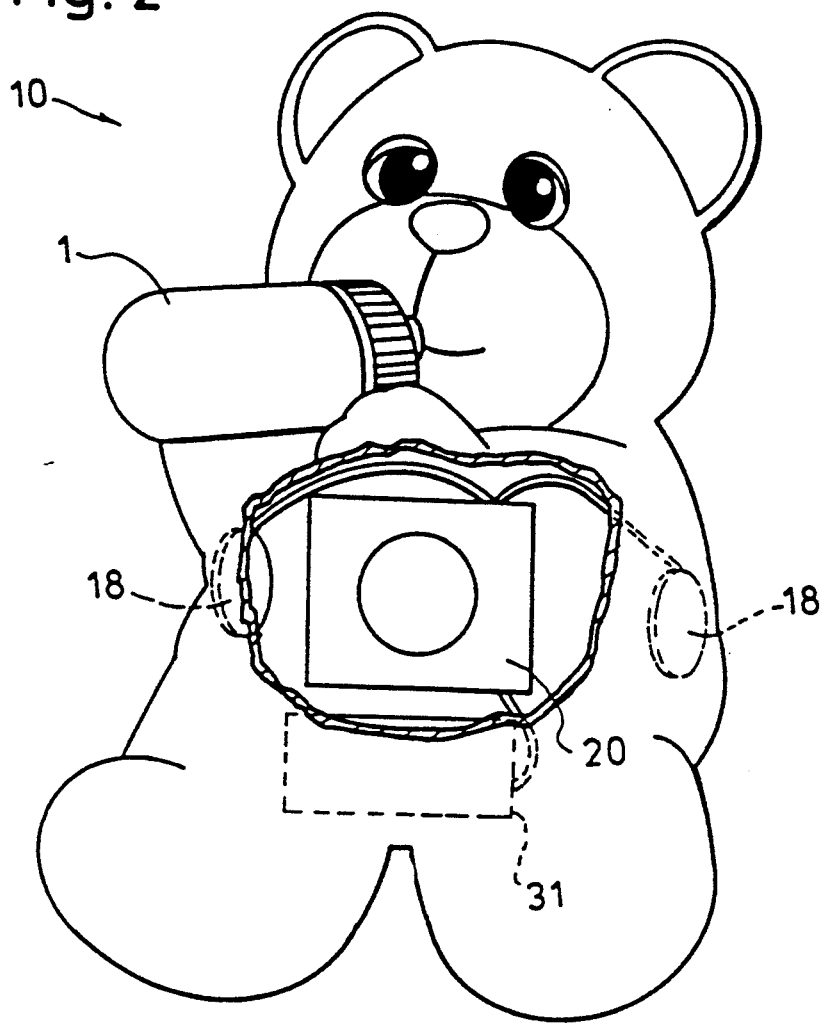
FIG. 2 is a cut-away view of a teddy bear doll of the present invention taken from a front side.
FIG. 4 is a table of signals inputted into the addressing circuit and outputted to the speaker of the present invention.

As shown in FIG. 2, when the nursing bottle 1 is inseted within the mouth 11 of the doll 10, the movable portion 13 of the sensor 12 is pushed by the top portion 2 so that the contact points 14, 15 are closed and switched to an on position, which leads the level of the signal $A_1$ to an "L" level.

Accordingly, addressing circuit 24 indicates to the memory circuit 25 the range of voice data desired. The appropriate sound is then emitted by the speaker 30.

Passing the predetermined time of this successive state, the decision signal is output from the time decision circuit to the timer circuit 23 so that the level of the signal $A_3$ is set to an "H" level as long as the predetermined time, during which one can hear the sound of satisfaction, "Hahh," for example.

When the nursing bottle 1 is detached from the mouth 11 of the doll 10 before the predetermined time passes, the first timer circuit 22 operates to emit a crying voice.

Further pushing both sides of the doll 10, causes it to emit a joyful voice.

Thus, pushing the nursing bottle into the mouth 11, one can hear the sound as if the doll is really drinking milk, and when the time is not sufficient, it utters a crying voice. To the contrary, when the time is sufficient and the predetermined time passes, it emits a voice of satisfaction, so that one can get a feeling of actually given milk to the doll.

In the above-mentioned embodiment, though it explains a case wherein the invention is applied to a teddy bear doll, it can also be applied to other animal-shape dolls or baby-shape dolls.

As explained in the case of drinking milk with a nursing bottle in the forementioned embodiment, this may be substituted for eating ice cream or cookies for example.

Further, though a mechanical switch is employed as a sensor which works when an object is inserted within a mouth, it may also employ a sensor which cuts off the light once the object is inserted and which senses magnetic forces of a magnet secured to the object.

As mentioned above, being made to emit a sound by inserting an object within the mouth, the doll of this invention seems as if it is drinking or is actually eating.

I claim:

1. A doll having a body of a desired shape and a mouth and having a sensor for determining the insertion of a top portion of a nursing bottle and which causes said doll to emit a bottle drinking sound upon insertion of the bottle in the mouth of said doll, a crying sound if the bottle is removed too soon, a satisfaction sound if the bottle remains in the mouth of said doll for a preset period of time, and a fourth sound which can be hand activated, said doll comprising:

a nursing body sensor having a movable portion positioned within the mouth, said movable portion pivoting in response to insertion of a top portion of said nursing bottle into the mouth;

a contact point secured to one end of said movable portion, said contact point pivoting with said movable portion;

a stationary contact member engaged by said contact point when said movable portion is pivoted by said top portion of said nursing bottle when it is inserted into the mouth to generate a first signal to initiate the bottle drinking sound;

a time decision circuit activated by said first signal to generate a first decision signal for the preset period of time after which said first decision signal is terminated and said time decision circuit generates a second decision signal;

first and second timer circuits, said first timer circuit responsive to said first decision signal generated by said time decision circuit to generate a second signal to initiate the crying sound; and said second timer circuit responsive to said second decision signal to generate a third signal to initiate the satisfaction sound;

an addressing circuit for generating an address in response to said first, second, and third signals; and a sound emitting apparatus placed within said doll for emitting the various sounds.

2. The doll as disclosed in claim 1, further having a spring biasing said movable portion to displace said contact point away from said contact member.

3. The doll as disclosed in claim 1, further having a guide portion positioned beneath said movable portion, said guide portion urging said top portion of said inserted nursing bottle to pivotably displace said movable portion and engage said contact point with said contact member.

4. The doll as disclosed in claim 1, further comprising a memory circuit responsive to said address generated by said addressing circuit to output digital data, a DA transducer for converting said digital data to analog signals, an amplifier for amplifying said analog signals, and a speaker for generating audible sounds in response to said amplified audio signals.

5. The doll as disclosed in claim 1 further comprising electrical switches placed on opposing sides of said doll, said electrical switches activating upon application of pressure to said opposing sides of said doll to generate a fourth signal to in turn generate the fourth sound.

* * * * *